US007955242B2

(12) United States Patent
Fontanazzi et al.

(10) Patent No.: US 7,955,242 B2
(45) Date of Patent: Jun. 7, 2011

(54) FOLDING UNIT FOR PRODUCING SEALED PACKAGES OF POURABLE FOOD PRODUCTS

(75) Inventors: Paolo Fontanazzi, Modena (IT); Fabrizio Rimondi, Castel San Piero Terme (IT); Massimo Pradelli, Reggio Emilia (IT); Giorgio Mattioli, Modena (IT); Mauro Ferrari, Reggio Emilia (IT)

(73) Assignee: Tetra Laval Holdings & Finanace S.A., Pully (CH)

( * ) Notice: Subject to any disclaimer, the term of this patent is extended or adjusted under 35 U.S.C. 154(b) by 0 days.

(21) Appl. No.: 12/162,717

(22) PCT Filed: Feb. 26, 2007

(86) PCT No.: PCT/EP2007/051818

§ 371 (c)(1),
(2), (4) Date: Jul. 30, 2008

(87) PCT Pub. No.: WO2007/099087

PCT Pub. Date: Sep. 7, 2007

(65) Prior Publication Data

US 2009/0193763 A1 Aug. 6, 2009

(30) Foreign Application Priority Data

Feb. 28, 2006 (EP) ..... 06110478

(51) Int. Cl.
*B65B 61/24* (2006.01)

(52) U.S. Cl. ..... 493/247; 53/372.7; 53/375.7

(58) Field of Classification Search ..... 493/184, 493/133.2, 246, 247, 250, 175, 162, 172–174, 493/183, 416, 417, 452, 453; 53/565, 371.7, 372.2, 372.5, 372.7, 374.7, 375.2, 375.5, 375.7; *B65B 61/24*

See application file for complete search history.

(56) References Cited

U.S. PATENT DOCUMENTS 3,334,551 A * 8/1967 Cawley ..... 493/196

(Continued)

FOREIGN PATENT DOCUMENTS

EP 1 440 010 B1 7/2004

(Continued)

OTHER PUBLICATIONS

Form PCT/ISA/210 (International Search Report) dated Apr. 25, 2008.

(Continued)

*Primary Examiner* — Stephen F Gerrity
(74) *Attorney, Agent, or Firm* — Buchanan Ingersoll & Rooney PC

(57) ABSTRACT

A folding unit for producing sealed packages of pourable food products from respective packs, each having a main portion folded into a desired shape, and opposite end portions to be folded to form respective folded ends of a relative finished package. The unit has a first folding station, in turn having a first retaining mechanism for securing each pack by a relative first end portion, and a first folding mechanism for folding a relative second end portion of the pack. The unit also has a second folding station located downstream from the first folding station in the traveling direction of the packs, a second retaining mechanism for securing each pack by the relative folded second end portion, and a second folding mechanism for folding the relative first end portion.

16 Claims, 9 Drawing Sheets

U.S. PATENT DOCUMENTS

| | | | | | |
|---|---|---|---|---|---|
| 3,513,755 | A | * | 5/1970 | Nestler et al. | 493/194 |
| 3,796,140 | A | * | 3/1974 | Adams et al. | 493/244 |
| 3,831,343 | A | * | 8/1974 | Dominici | 53/372.6 |
| 4,510,732 | A | | 4/1985 | Löthman | |
| 4,528,803 | A | * | 7/1985 | Ott | 493/247 |
| 4,614,078 | A | * | 9/1986 | Kawabe | 493/208 |
| 5,031,385 | A | * | 7/1991 | Wada | 53/376.6 |
| 5,121,588 | A | * | 6/1992 | Abate | 53/375.9 |
| 5,809,743 | A | | 9/1998 | Ylonen et al. | |
| 5,867,966 | A | * | 2/1999 | Mogard | 53/133.2 |
| 6,599,225 | B2 | * | 7/2003 | Ammons et al. | 493/183 |
| 7,090,630 | B2 | * | 8/2006 | Boldrini et al. | 493/51 |

FOREIGN PATENT DOCUMENTS

| | | | |
|---|---|---|---|
| EP | 1 584 563 | A1 | 10/2005 |
| JP | 01240432 | A * | 9/1989 |
| JP | 01240434 | A * | 9/1989 |

OTHER PUBLICATIONS

Form PCT/ISA/237 (Written Opinion of the International Searching Authority) dated Apr. 25, 2008.

* cited by examiner

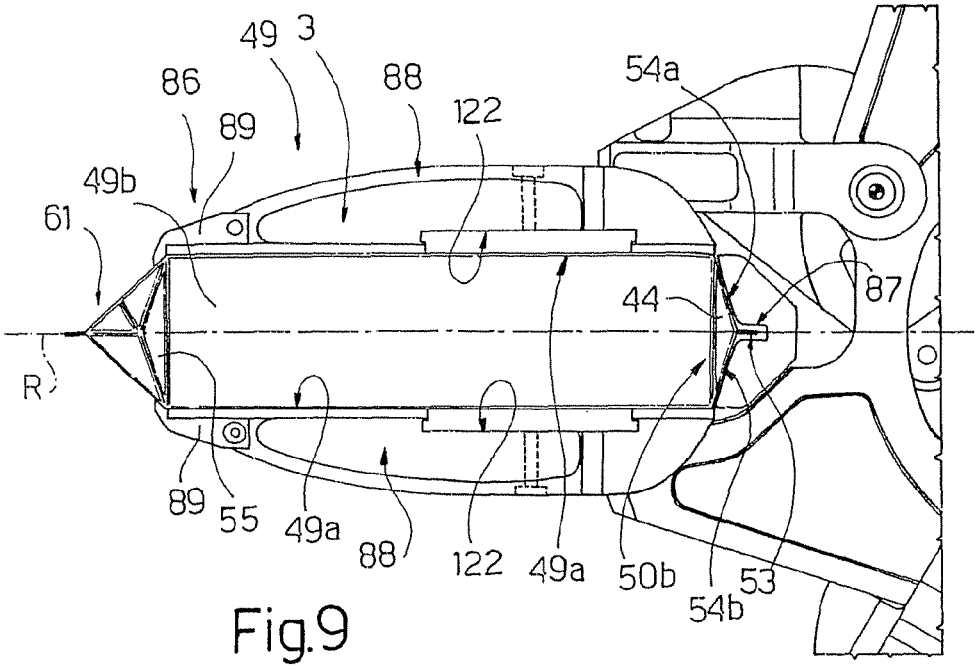
Fig.9
Fig.10
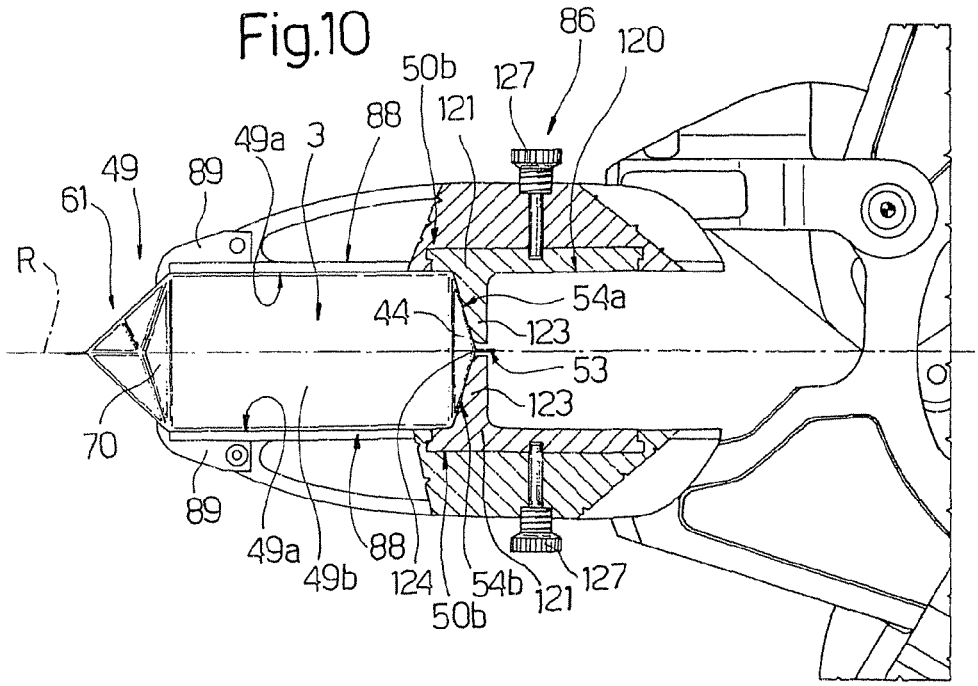

FOLDING UNIT FOR PRODUCING SEALED PACKAGES OF POURABLE FOOD PRODUCTS

TECHNICAL FIELD

The present invention relates to a folding unit for producing sealed packages of pourable food products from a tube of packaging material.

BACKGROUND ART

Many pourable food products, such as beverages, fruit juice, pasteurized or UHT (ultra-high-temperature treated) milk, wine, tomato sauce, etc., are sold in packages made of sterilized packaging material.

One example of this type of package is the parallelepiped-shaped package for liquid or pourable food products known by the trade name Tetra Brik Aseptic (registered trademark).

Another example of this type of package is the gable-top package for liquid or pourable food products, to which the following description refers purely by way of example, as described in European Patent EP1440010 and in published Patent Application EP1584563, and known by the trade name Tetra Gemina™ Aseptic.

In both cases, the package is produced by folding and sealing laminated strip packaging material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. More specifically, the web of packaging material is unwound off a reel and fed through an aseptic chamber on the packaging machine, where it is sterilized, e.g. by applying a sterilizing agent, such as hydrogen peroxide, which is subsequently evaporated by heating and/or by subjecting the packaging material to radiation of appropriate wavelength and intensity; and the web so sterilized is maintained in a closed, sterile environment, is folded into a cylinder, and is sealed longitudinally to form a continuous tube in known manner.

The tube of packaging material, actually forming an extension of the aseptic chamber, is fed continuously in a vertical direction, is filled with the sterilized or sterile-processed food product, and is fed through a forming unit for producing the individual packages. That is, inside the forming unit, the tube is sealed along a number of equally spaced cross sections to form a continuous strip of pillow packs connected to one another by respective transverse sealing strips, i.e. extending perpendicular to the travelling direction of the tube.

More specifically, each pillow pack comprises a parallelepiped-shaped main portion; and opposite, respectively top and bottom, end portions tapering from the main portion towards respective sealing strips. Each end portion has substantially triangular flaps projecting from opposite sides of the main portion, and a narrow rectangular tab projecting from the relative sealing strip.

The pillow packs are separated by cutting the relative transverse sealing strips, and are then folded further to form respective finished packages.

In the case of parallelepiped-shaped packages, the end portions are first flattened, and then the top flaps are folded onto respective lateral walls of the main portion, and the bottom flaps are folded onto the flattened bottom end portion.

In the case of gable-top packages, on the other hand, the top end portion of the pack is folded to form two sloping walls joined at a sealing strip, and the flaps of the bottom end portion are folded onto the flattened bottom end portion.

Within the industry, a need is felt for versatile folding units, i.e. designed to produce, quickly and with a small number of operations, packages of different heights, i.e. from pillow packs of different-sized main portions.

DISCLOSURE OF INVENTION

It is an object of the present invention to provide a folding unit, for pourable food product packaging machines, designed to meet the above requirement.

According to the present invention, there is provided a folding unit for producing sealed packages of pourable food products from respective packs, each having a main portion folded into a desired shape, and opposite end portions to be folded to form respective folded ends of a relative finished package; said unit being characterized by comprising: a first folding station, in turn comprising first retaining means for securing each said pack by a relative first said end portion, and first folding means for folding a relative second said end portion of said pack; and a second folding station located downstream from said first folding station in the travelling direction of said packs, and in turn comprising second retaining means for securing each said pack by the relative folded said second end portion, and second folding means for folding the relative said first end portion.

BRIEF DESCRIPTION OF THE DRAWINGS

A preferred, non-limiting embodiment of the present invention will be described by way of example with reference to the accompanying drawings, in which:

FIG. 9 shows a detail of the FIG. 1 unit;

FIG. 10 shows an assembly which interacts with the FIG. 9 detail;

BEST MODE FOR CARRYING OUT THE INVENTION

Figure 1:
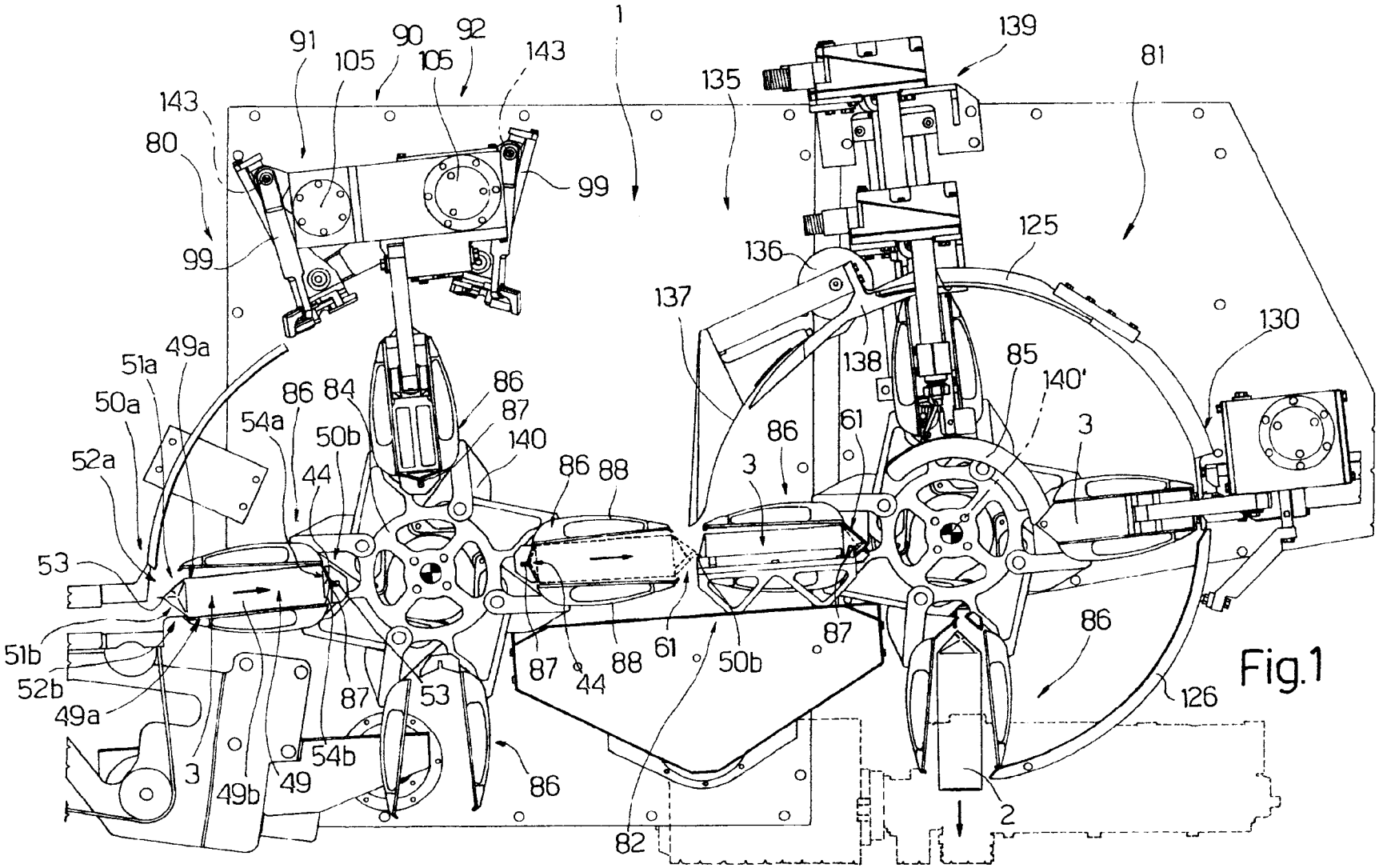
FIG. 1 shows a side view of a folding unit in accordance with the present invention.

Number 1 in FIG. 1 indicates as a whole a folding unit of a packaging machine (not shown) for continuously producing sealed gable-top packages 2 (FIG. 3) of a pourable food product, such as pasteurized or UHT milk, fruit juice, wine, etc., from a known tube (not shown) of packaging material.

The tube is formed in known manner upstream from unit 1 by longitudinally folding and sealing a web of heat-seal sheet material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages 2 for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of package 2 eventually contacting the food product.

Figure 2:
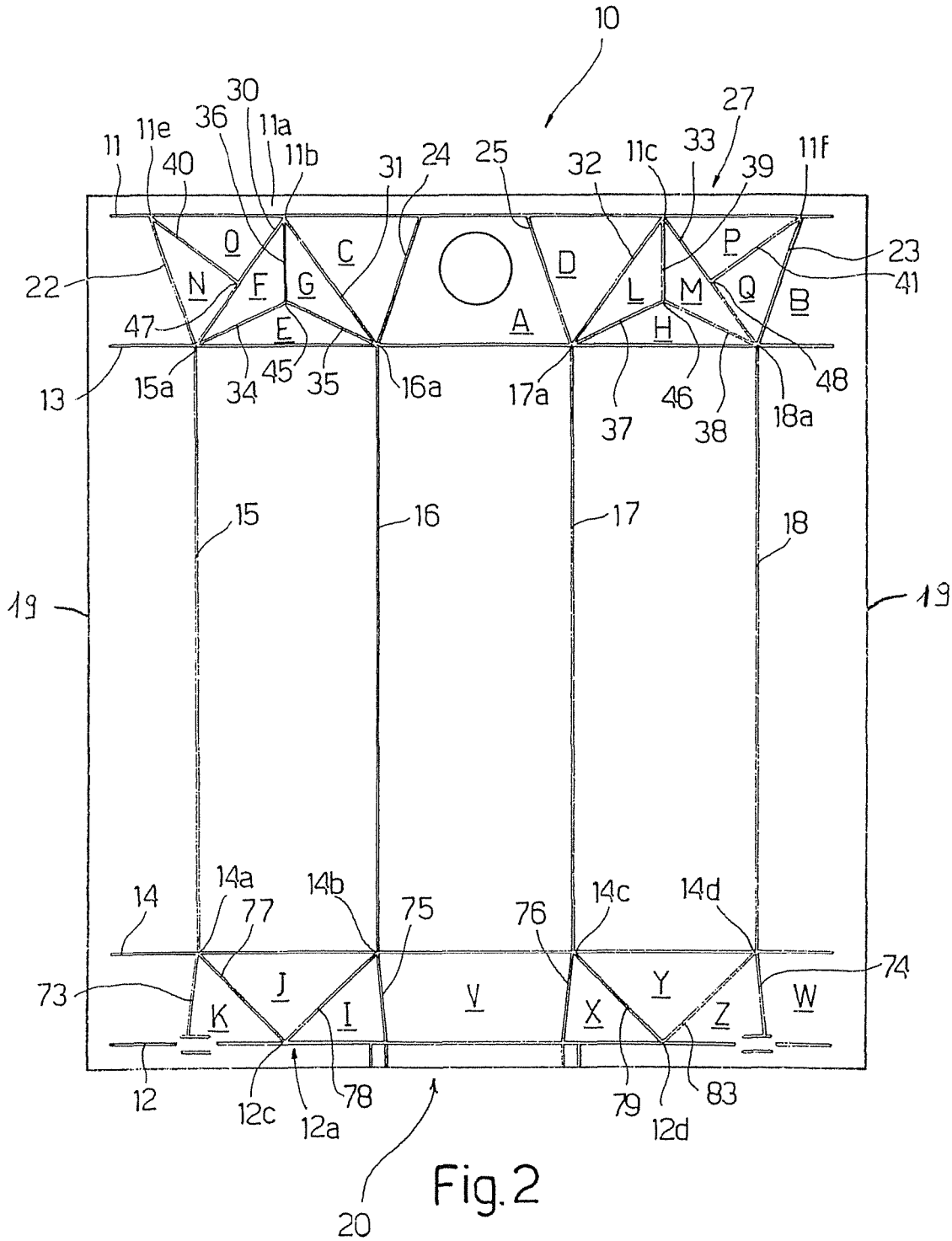
FIG. 2 shows a web of packaging material having a number of fold lines (crease pattern)

With particular reference to FIG. 2, the web of packaging material comprises a crease pattern 10, i.e. a number of fold lines, along which the material is folded, during the folding operation, to form a pillow pack 3 first, and then package 2.

Crease pattern 10 comprises four transverse fold lines 11, 12, 13, 14. Lines 11, 12 are located close to the ends of the packaging material, and define respective top and bottom sealing areas 11*a*, 12*a*.

Crease pattern 10 comprises, in known manner, four longitudinal fold lines 15, 16, 17, 18 extending between transverse fold lines 13, 14.

Lines 15, 18 are located close to lateral edges 19 of the packaging material, and lines 16, 17 are interposed between lines 15 and 18.

Crease pattern 10 also comprises a number of first additional fold lines located in the area between lines 11 and 13.

The first additional lines comprise two fold lines 22, 23 extending obliquely between lines 11, 13 and converging from line 11 to line 13; and two fold lines 24, 25 extending between lines 1, 13 and converging from line 13 to line 11.

Lines 22, 23, 24, 25 originate at respective intersection points 15*a*, 18*a*, 16*a*, 17*a* of respective lines 15, 18, 16, 17 and line 13, and, in the embodiment shown, slope slightly in the longitudinal direction.

Lines 22 and 24, the portion of line 13 between points 15*a* and 16*a*, and the portion of line 11 between the intersection point of lines 11 and 24 and an intersection point 11*e* of lines 22 and 11, define an area 26. Similarly, lines 23 and 25, the portion of line 13 between points 17*a* and 18*a*, and the portion of line 11 between an intersection point 11*f* of lines 11 and 23 and the intersection point of lines 11 and 25, define an area 27.

Lines 24 and 25, the portion of line 11 between the intersection points of lines 24, 25 and line 11, and the portion of line 13 between the intersection points of lines 24, 25 and line 13, define a panel A interposed between areas 26 and 27 and in the form of an isosceles trapezium with the oblique sides converging from line 13 to line 11.

Lines 22 and 23, the portion of line 11 extending between points 11*e* and 11*f*, on the opposite side to panel A, and the portion of line 13 extending between points 15*a* and 18*a*, on the opposite side to panel A, define a panel B interposed between areas 26 and 27 and in the form of an isosceles trapezium with the oblique sides converging from line 13 to line 11.

Crease pattern 10 comprises, in area 26, two fold lines 30, 31 originating respectively at points 15*a*, 16*a* and joined at a point 11*b* along line 11 to define an isosceles triangle with the portion of line 13 extending between points 15*a* and 16*a*.

Similarly, crease pattern 10 comprises, in area 27, a further two fold lines 32, 33 originating respectively at points 17*a* and 18*a* and joined at a point 11*c* along line 11 to define an isosceles triangle with the portion of line 13 extending between points 17*a* and 18*a*.

Lines 31, 24 and the portion of line 11 extending between point 11*b* and the intersection point of lines 24 and 11, define the outer boundaries of a triangular panel C adjacent to panel A. And, similarly, lines 32, 25 and the portion of line 11 extending between point 11*c* and the intersection point of lines 25 and 11, define the outer boundaries of a triangular panel D adjacent to panel A and on the opposite side to panel C.

Crease pattern 10 comprises three lines 34, 35, 36 in area 26, and three lines 37, 38, 39 in area 27; lines 34, 35, 36 extend respectively from points 15*a*, 16*a*, 11*b* to a point 45 within the isosceles triangle in area 26; and lines 37, 38, 39 extend respectively from points 17*a*, 18*a*, 11*c* to a point 46 within the isosceles triangle in area 27.

Lines 34, 35 extend symmetrically on opposite sides of an extension of line 36; and lines 37, 38 extend symmetrically on opposite sides of an extension of line 39.

There are therefore defined, in area 26, a panel E in the form of an isosceles triangle and bounded by lines 34, 35 and the portion of line 13 extending between points 15*a*, 16*a*; a triangular panel F bounded by lines 30, 34, 36; and a triangular panel G bounded by lines 31, 35, 36.

Similarly, there are defined, in area 27, a panel H in the form of an isosceles triangle and bounded by lines 37, 38 and the portion of line 13 extending between points 17*a*, 18*a*; a triangular panel L, bounded by lines 32, 37, 39; and a triangular panel M bounded by lines 33, 39, 38.

Crease pattern 10 also comprises, in area 26, a line 40 extending between intersection point 11*e* of lines 11 and 22, and a point 47 located substantially at the mid-point of line 30. And, in the same way, crease pattern 10 comprises, in area 27, a line 41 extending between the intersection point 11*f* of lines 11 and 23, and a point 48 located substantially at the mid-point of line 33.

There are therefore defined, in area 26, a triangular panel N bounded by lines 22, 40 and the portion of line 30 extending between points 15*a* and 47; and a triangular panel O bounded by line 40, the portion of line 11 extending between points 11*e* and 11*b*, and the portion of line 30 extending between points 11*b* and 47.

Similarly, there are defined, in area 27, a triangular panel Q bounded by lines 23, 41 and the portion of line 33 extending between points 18*a* and 48; and a triangular panel P bounded by line 41, the portion of line 33 extending between points 11*c* and 48, and the portion of line 11 extending between points 11*c* and 11*f*.

Crease pattern 10 also comprises a number 20 of second additional fold lines located in the area between line 14 and sealing area 12*a*. The lines in number 20 are folded to form lateral flaps 128 (FIGS. 11 and 12), which are later folded to form a bottom wall 62 of package 2.

The lines in number 20 comprise two fold lines 73, 74 extending obliquely between lines 12, 14 and converging from line 12 to line 14; and two fold lines 75, 76 extending between lines 12, 14 and converging from line 14 to line 12.

Lines 73, 74, 75, 76 originate respectively at intersection points 14*a*, 14*d*, 14*b*, 14*c* of respective lines 15, 18, 16, 17 and line 14.

Lines 75 and 76, the portion of line 14 extending between points 14*b* and 14*c*, and the portion of line 12 extending between the intersection points of lines 75, 76 and line 12, define a panel V in the form of an isosceles trapezium with the oblique sides converging from line 14 to line 12.

Lines 73 and 74, the portion of line 14 extending between points 14*a*, 14*d*, on the opposite side to panel V, and the portion of line 12 extending between the intersection points of lines 73, 74 and line 12, on the opposite side to panel V, define a panel W in the form of an isosceles trapezium with the oblique sides converging from line 14 to line 12.

Crease pattern 10 comprises two lines 77, 78 extending between respective points 14*a*, 14*b* and a point 12*c* located along line 12 and halfway between the intersection points of lines 73, 75 and line 12. Similarly, crease pattern 10 comprises two lines 79, 83 extending between respective points 14*c*, 14*d* and a point 12*d* located along line 12 and halfway between the intersection points of lines 74, 76 and line 12.

Lines 75 and 78, and the portion of line 12 extending between point 12*c* and the intersection point of lines 12 and 75, define a triangular panel I adjacent to panel V; lines 73 and 77, and the portion of line 12 extending between point 12*c* and the intersection point of lines 12 and 73, define a triangular panel K adjacent to panel W; and lines 77 and 78, and the portion of line 14 extending between points 14*a* and 14*b*, define a triangular panel J interposed between panels I and K.

Lines 76 and 79, and the portion of line 12 extending between point 12*d* and the intersection point of lines 12 and 76, define a triangular panel X adjacent to panel V; lines 74 and 83, and the portion of line 12 extending between point 12*d* and the intersection point of lines 12 and 74, define a triangular panel Z adjacent to panel W; and lines 79 and 83, and the portion of line 14 extending between points 14*c* and 14*d*, define a triangular panel Y interposed between panels X and Z.

Once formed, the tube of packaging material is filled with the food product for packaging, and is sealed and cut along equally spaced cross sections to form a number of pillow packs 3 (shown in FIG. 1).

Figure 8:
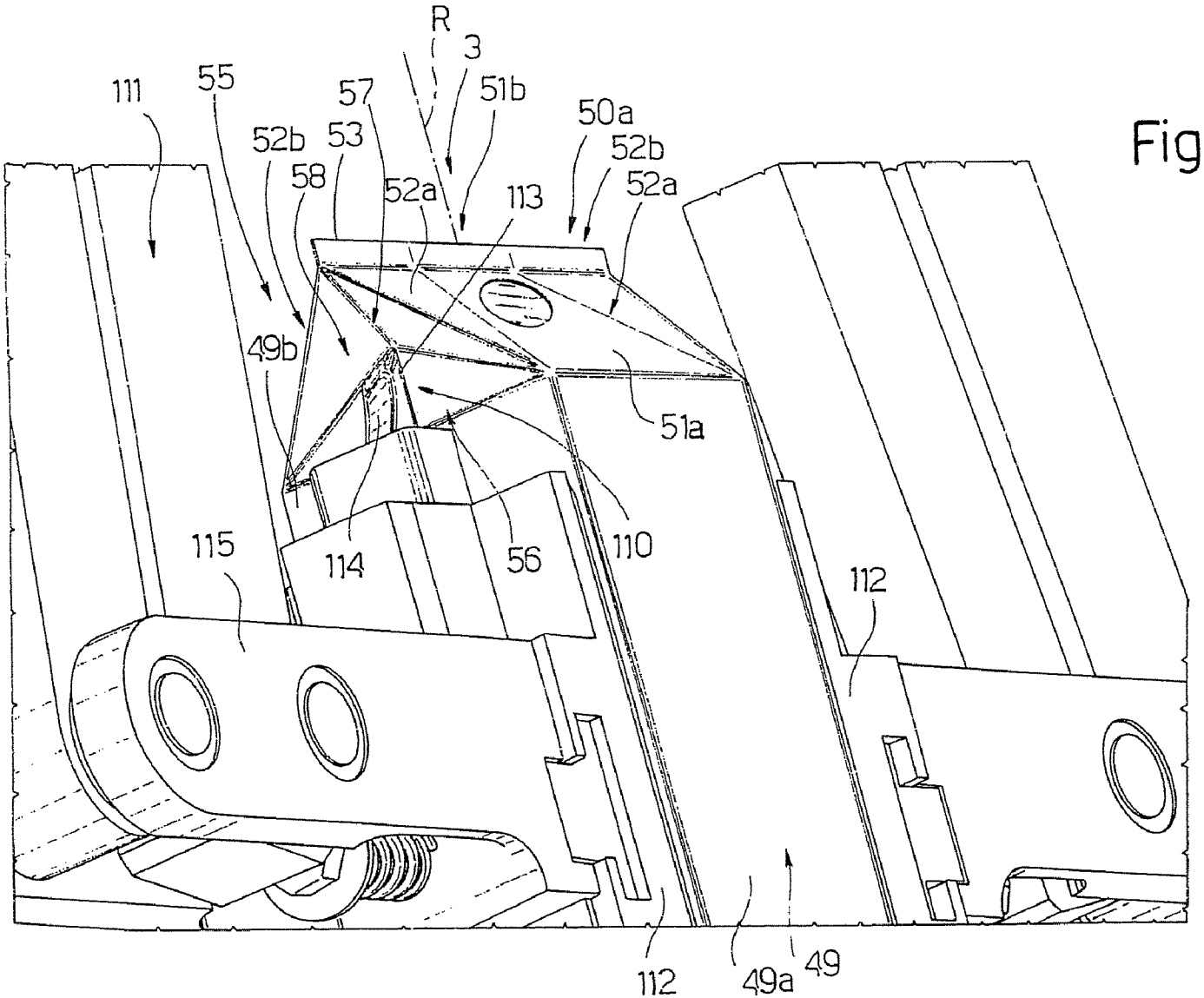
FIG. 8 shows a component part of the first folding assembly in FIGS. 4 to 7, as it interacts with a pillow pack when forming the gable portion.

FIG. 8 shows a partial view of pack 3 at the start of forming a gable portion 61 (FIG. 3) of corresponding package 2.

More specifically, packs 3 extend along an axis R, and each comprise in known manner a parallelepiped-shaped main portion 49, and opposite end portions 50*a*, 50*b* (only one shown in FIG. 8) tapering from portion 49 towards respective transverse sealing strips 53 of pack 3.

Portion 49 corresponds to the area of the web extending between lines 13 and 14. More specifically, said area is folded along lines 15, 16, 17 and 18 to form two parallel walls 49*a* (only one shown in FIG. 8), and two parallel walls 49*b* (only one shown in FIG. 8) perpendicular to walls 49*a*.

Walls 49*a* correspond to the areas between lines 16 and 17 and between lines 15 and 18; and walls 49*b* correspond to the areas between lines 15 and 16 and between lines 17 and 18.

Portions 50*a*, 50*b* correspond to the areas of the web extending between lines 11 and 13 and between lines 12 and 14 respectively; and strips 53 correspond to areas 11*a*, 12*a* of the web of packaging material.

Each portion 50*a* and 50*b* is defined by a respective pair of walls 51*a*, 51*b* and 54*a*, 54*b* (FIG. 1), which are substantially in the form of an isosceles trapezium, slope slightly towards each other with respect to a plane perpendicular to the longitudinal axis R of pack 3, and have major edges defined by respective end edges of opposite walls 49*a*, and minor edges joined to each other by relative strip 53.

More specifically, walls 51*a*, 51*b* of portion 50*a* correspond respectively to panels A, B of the web of packaging material.

Similarly, walls 54*a*, 54*b* of portion 50*b* correspond respectively to panels V, W of the web of packaging material.

Each pack 3 comprises, on wall 51*a* of portion 50*a*, two substantially triangular portions 52*a* projecting laterally on opposite sides of wall 51*a* and defined by end portions of wall 51*a*.

Similarly, each pack 3 comprises, on wall 51*b* of portion 50*a*, two substantially triangular portions 52*b* projecting laterally on opposite sides of wall 51*b* and defined by end portions of wall 51*b*.

With reference to portion 50*a*, portions 52*a* of wall 51*a* correspond respectively to panels C and D, and portions 52*b* of wall 51*b* correspond respectively to panels N, O and Q, P of the web of packaging material.

Each pack 3 comprises, on wall 54*a*, two substantially triangular portions 59*a*(shown in FIGS. 11 and 12 relative to a pack 3 whose portion 50*a* has been folded to form portion 61 of package 2) projecting laterally on opposite sides of wall 54*a* and defined by end portions of wall 54*a*.

Similarly, each pack 3 comprises, on wall 54*b*, two substantially triangular portions 59*b* (also shown only in FIGS. 11 and 12) projecting laterally on opposite sides of wall 54*b* and defined by end portions of wall 54*b*.

Portions 59*a* of wall 54*a* correspond respectively to panels I and X of the web of packaging material, and portions 59*b* of wall 54*b* correspond respectively to panels K and Z of the web.

Each portion 52*a* of wall 51*a* is connected to a corresponding portion 52*b* of wall 51*b* by a respective lateral face 55 projecting from one end of a relative wall 49*b*. Each face 55 comprises a respective surface 56 in the form of an isosceles triangle and extending upwards from respective wall 49*b*; and a respective pair of triangular surfaces 57, 58 having a first side in common. Each surface 57, 58 also has a second side in common with surface 56, and a third side in common with a relative portion 52*a*, 52*b*.

Faces 55 correspond respectively to the isosceles triangle defined by points 11*b*, 16*a*, 15*a* of the packaging material, and to the isosceles triangle defined by points 17*a*, 18*a*, 11*c*.

Surfaces 56 correspond respectively to panels E, H of the web of packaging material; surfaces 57 and 58 of a first face 55 correspond respectively to panels G, F of the web of packaging material; and surfaces 57, 58 of a second face 55 correspond respectively to panels L, M.

Each portion 59*a* of wall 54*a* is connected to a corresponding portion 59*b* of wall 54*b* by a respective lateral face 44 (shown in FIGS. 1, 9, 10) projecting, at the opposite end to relative face 55, from relative wall 49*b*.

More specifically, faces 44 correspond respectively to panels J and Y.

Packs 3 are then sent to unit 1, where they are folded mechanically to form respective packages 2.

Figure 3:
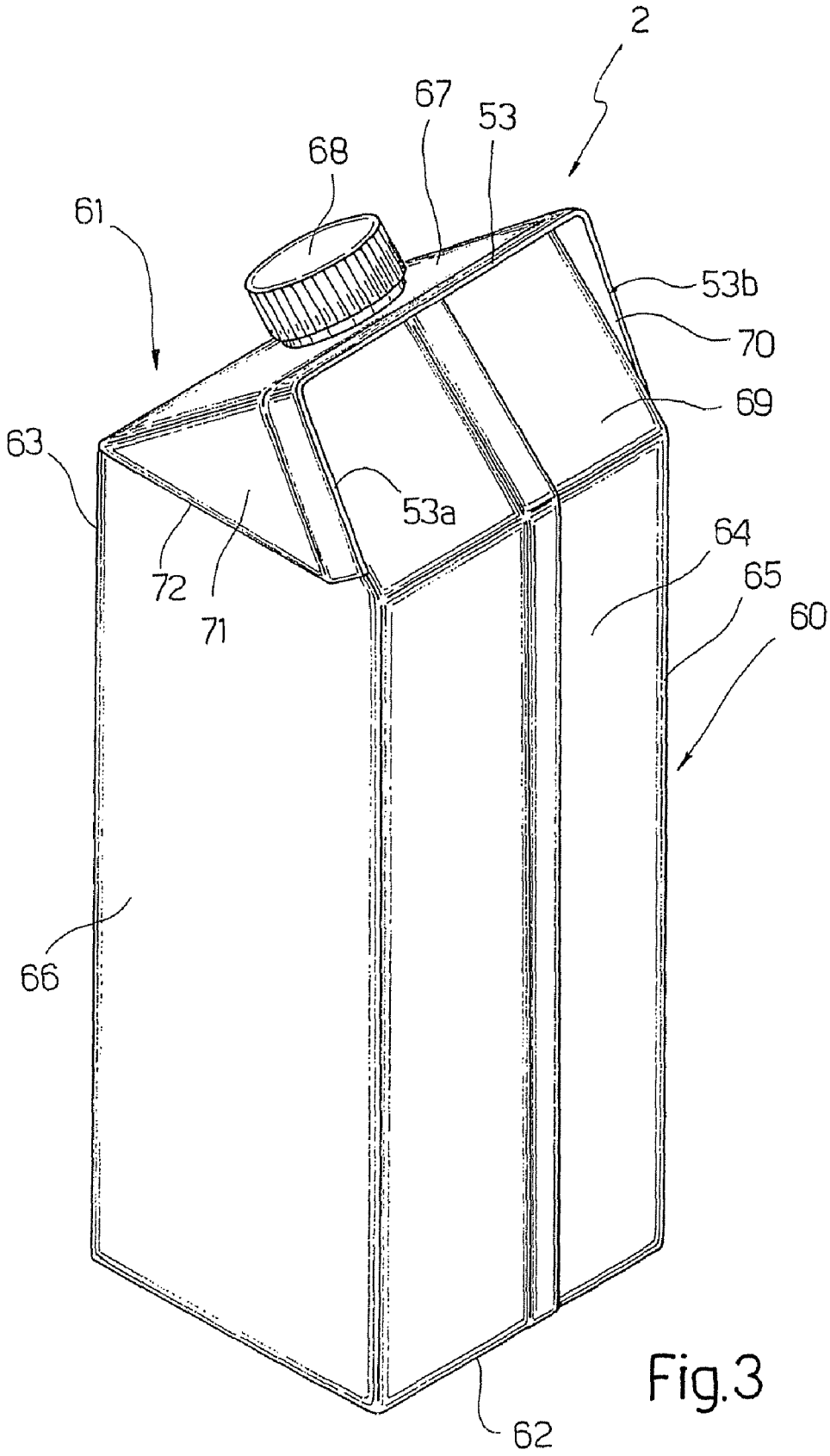
FIG. 3 shows the gable-top package produced by the FIG. 1 folding unit.

With particular reference to FIG. 3, packages 2 each substantially comprise a parallelepiped-shaped main portion 60 corresponding to portion 49 of pack 3; and gable portion 61, which defines the top of portion 60 and is formed by folding portion 50*a* of pack 3 on unit 1, as described in detail below.

Package 2 also comprises bottom wall 62 defining the bottom of portion 60 and formed by folding portion 50*b* of pack 3 on unit 1, also as described in detail below; two parallel walls 63, 64; and two parallel walls 65, 66 extending perpendicularly between walls 63, 64 of package 2.

More specifically, walls 63, 64, 65, 66 extend perpendicularly to the plane of wall 62.

Walls 63 and 64 correspond respectively to the areas of the web extending between lines 16 and 17 and between lines 15 and 18; and walls 65 and 66 correspond respectively to the areas of the web extending between lines 15 and 16 and between lines 17 and 18.

Portion 61 comprises a wall 67 having an opening device 68; and a wall 69 joined to wall 68 at top sealing strip 53.

More specifically, walls 67 and 69 are each in the form of an isosceles trapezium, slope with respect to walls 63, 64, 65 and 66, converge towards top strip 53, extend at their respective major bases from respective walls 63 and 64, and are joined at their respective minor bases adjacent to top strip 53.

Walls 67 and 69 correspond respectively to panels A and B of the web of packaging material.

Portion 61 also comprises two lateral flaps 70, 71 folded outside the volume of package 2 available for the food product, and extending along extensions of, and obliquely with respect to, respective walls 65, 66.

More specifically, each flap 70, 71 is triangular and defined by a respective oblique side of wall 67, by a relative end 53*b*, 53*a* of strip 53 folded onto a relative oblique side of wall 69, and by a relative edge 72 parallel, when folded, to relative wall 65, 66.

More specifically, flaps 70, 71 correspond respectively to panels C, D of the web of packaging material, and are folded to superimpose lines 31, 32 on respective lines 22, 23.

Unit 1 advantageously comprises a first folding station 80, in turn comprising a number of devices 86, each for retaining a relative pack 3 by portion 50*b*, and a first folding assembly 90 for folding portion 50*a* of pack 3 to form portion 61. Unit 1 also comprises a second folding station 81 located downstream from first folding station 80 in the travelling direction of packs 3, and in turn comprising a number of devices 86, each for retaining a relative pack 3 by portion 50*a* previously folded to form portion 61, and a second folding assembly 130 for folding portion 50*b* of pack 3 to form wall 62.

Unit 1 also comprises a conveyor 82 for transferring pack 3 from station 80 to station 81.

Conveyor 82 moves back and forth between stations 80 and 81, and performs a forward movement to supply station 81 with a pack 3 whose portion 50*a* has been folded to form portion 61 of package 2, and a return movement in which it is empty.

More specifically, each station 80, 81 comprises a respective hub 84, 85 rotated about a respective axis 140 by a respective motor not shown; and a respective number of devices 86—four in the example shown—angularly integral with relative hub 84, 85 and moved by the relative hub along an arc-shaped path about relative axis 140.

More specifically, axes 140, about which hubs 84, 85 rotate, are parallel to each other and spaced apart.

First and second folding assembly 90, 130 are located radially outwards of devices 86 with reference to axes 140 of relative hubs 84, 85.

Devices 86 are fixed, equally spaced angularly, to relative hub 84, 85, and each define a respective open housing for pack 3.

More specifically, the housing defined by each device 86 is bounded, on the said facing relative hub 84, 85, by a groove 87 for engaging relative strip 53 and retaining pack 3 radially; and by two paddles 88 which cooperate respectively with walls 49*a* of pack 3 corresponding to walls 63, 64 of package 2, to retain pack 3 circumferentially with respect to relative axis 140.

The housing is open at the opposite end to relative hub 84, 85, to permit insertion and/or withdrawal of relative pack 3 from device 86.

With particular reference to FIGS. 9 and 10, each paddle 88 of each device 86 comprises, on its outer end, an edge 89 bent towards the other paddle 88 of the same device 86, to prevent pack 3 spinning off as hubs 84, 85 rotate. More specifically, each edge 89 is tooth-shaped and hinged to relative paddle 88.

Each device 86 at station 80 receives a pack 3 in a first angular position, in which pack 3 is inclined slightly with respect to a horizontal plane; feeds it clockwise along a roughly ninety-degree arc to a second angular position, in which assembly 90 forms portion 61; and then feeds pack 3, complete with portion 61, along a further roughly ninety-degree clockwise arc to a third angular position, where pack 3 is picked up by conveyor 82 and transferred to station 81.

Along the arc between the first and third angular position, devices 86 of station 80 are set to a closed configuration in which paddles 88 cooperate with walls 49*a* of pack 3 to retain pack 3 inside the housing defined by paddles 88 and groove 87.

In the first and third angular position, on the other hand, devices 86 of station 80 are set to an open configuration in which paddles 88 of each device 86 are parted to permit insertion/withdrawal of relative pack 3. More specifically, each pack 3 is inserted/withdrawn through the open end of the respective housing defined by relative device 86.

More specifically, as packs 3 are advanced, groove 87 of each device 86 of station 80 is engaged by portion 50*b* of relative pack 3.

Each device 86 may advantageously be fitted with a respective adapting assembly 120 (shown in FIG. 10) to reduce the size of the housing of pack 3 between paddles 88 and so enable devices 86 to be used with packs 3 having respective portions 49 of different sizes.

More specifically, assembly 120 comprises two bodies 121 having, on opposite sides, respective end walls which fit inside respective grooves 122 formed along the inside edge of respective paddles 88, and respective projections 123 defining between them a seat 124 engaged by strip 53 of relative pack 3.

Projections 123 are interposed, radially with respect to relative axis 140, between relative axis 140 and the open end of the housing, so as to retain inside relative device 86 packs 3 having different-sized portions 49.

On the opposite side to relative hub 84, 85, projections 123 slope with respect to axis R of pack 3 housed inside device 86, so as to cooperate with relative portion 50*a*, 50*b* of pack 3.

Each body 121 is fixed releasably to relative paddle 88 by a respective threaded fastener 127.

Assembly 90 interacts, on opposite sides of axis R of each pack 3, with portions 52*a*, 52*b* of pack 3, to fold each portion 52*b* onto relative surface 56, and each portion 52*a* onto relative portion 52*b* to form a relative flap 70, 71 of package 2.

With reference to FIGS. 4 to 7, assembly 90 comprises two tools 91, 92 for folding each portion 52*b* onto relative surface 56, and each portion 52*a* onto relative portion 52*b* respectively. More specifically, each portion 52*b* is folded onto relative surface 56 after first being folded onto relative line 40, 41.

Tools 91, 92 are hinged to respective output members of respective motors 105 about respective axes 141 parallel to axes 140, and are hinged to each other about a common axis 142 parallel to axes 141.

More specifically, tool 91 comprises a supporting surface 100 and two folding surfaces 101, which cooperate respectively with wall 51*b* to control the volume of portion 61 being formed, and with portions 52*b* to fold them onto relative surfaces 56.

Surfaces 100 and 101 are moved integrally with one another in an approach movement into contact with wall 51*b* and portions 52*b* respectively, and are moved with respect to one another in a folding movement in which surfaces 101 fold portions 52*b* onto relative surfaces 56.

More specifically, tool 91 comprises a frame 95 fitted, on one side, with projecting surface 100, and connected operatively, on the opposite side, to surfaces 101; two first levers 93 hinged to frame 95 and to the output member of relative motor 105; and a second lever 94 hinged to tool 92 and to frame 95.

Frame 95 comprises a first member 96 fitted on one end, and on the opposite side to axis 142, with projecting surface 100; and a second member 97 which slides with respect to member 96 and is hinged to levers 93 about an axis 143 parallel to axes 141, 142.

Levers 93 are hinged, at one end, to the output member of motor 105 about axis 141, and are hinged, at the opposite end, to frame 95 about axis 143.

Lever 94 is hinged, at one end, to tool 92 about axis 142, and is hinged, at the opposite end, to frame 95 about an axis 144 parallel to axis 142.

Tool 91 also comprises two third levers 99, each of which is hinged, at one end, to relative lever 93 about axis 143, and is connected operatively and movably, at the opposite end, to surface 100 and to a respective surface 101 by means of a respective connecting rod 102.

More specifically, each connecting rod 102 is L-shaped, is hinged at opposite ends to surface 100 and to a plate 107 integral with relative surface 101, and comprises an intermediate portion, between surface 100 and relative plate 107, which is housed inside a circular through seat formed on the end of relative lever 99 opposite axis 143.

Members 96 and 97 are connected elastically to each other by a spring 98, which is compressed during the folding movement of surfaces 101, and expands when surface 100 withdraws from wall 51*b*.

Tool 92 is similar to tool 91, and is only described insofar as it differs from tool 91, using the same reference numbers for identical or corresponding parts of tools 91, 92.

Tool 92 differs from tool 91 by relative surface 100 cooperating with wall 51*a* at the end of the relative approach movement.

Surfaces 101 are the same triangular shape as portions 52*a*, and fold portions 52*a* onto portions 52*b*, once surface 100 cooperates with wall 51*a*.

Tool 92 also comprises two levers 94 spaced apart and which are hinged to lever 94 of tool 91 about axis 142.

Folding assembly 90 also comprises two pressure members 110 (one shown in FIG. 8), each of which exerts pressure on a relative surface 56, when forming relative flap 70, 71, to facilitate folding of portions 52*a*, 52*b*.

More specifically, pressure members 110 are fitted to an actuating assembly 111 connected operatively to motor 105 of tool 91 in known manner not shown.

Assembly 111 (shown only partly in FIG. 8) comprises two plates 112, which cooperate with respective walls 49*b* of pack 3, and from which respective pressure members 110 project; and two lever mechanisms 115 connected to motor 105 of tool 91 by a cam mechanism not shown.

Motor 105 and lever mechanisms 115 are so connected that, when surface 100 of tool 91 cooperates with wall 51*b*, pressure members 110 cooperate with relative surfaces 56, and, when surface 100 of tool 91 is detached from wall 51*b*, pressure members 110 are detached from relative surfaces 56.

More specifically, pressure members 110 are preferably made of deformable plastic material, and are tooth-shaped. More specifically, each pressure member 110 comprises a flat surface 113 which cooperates with relative surface 56; and a surface 114, opposite surface 113, which tapers from relative plate 112 and cooperates with relative surfaces 57, 58 once portions 52*a*, 52*b* are folded.

Station 81 (FIG. 1) also comprises a prefolding assembly 135 for prefolding portion 50*b*; and a heating assembly 139 (not shown in detail) for heating and facilitating subsequent sealing of flaps 70, 71 to the oblique sides of walls 69. Each pack 3 is fed through assemblies 135, 139 before assembly 130.

More specifically, each device 86 at station 81 receives a pack 3, complete with portion 61, from conveyor 82 in a first angular position, in which pack 3 is inclined slightly with respect to a horizontal plane; feeds pack 3 clockwise along a roughly ninety-degree arc, thus causing it to interact with assembly 135, to a second angular position, in which heating assembly 139 heats flaps 70, 71; feeds pack 3 clockwise along a further roughly ninety-degree arc to a third angular position, in which assembly 130 folds portion 50*b* of pack 3 to form wall 62; and then feeds pack 3 clockwise through a further ninety degrees to a fourth angular position, where the finished package 2 is removed from unit 1.

Along the arc between the first and fourth angular position, devices 86 of station 81 are set to a closed configuration in which paddles 88 of each device 86 cooperate with walls 49*a* of pack 3 to retain pack 3 inside the housing defined by paddles 88 and groove 87.

In the first and fourth angular position, on the other hand, devices 86 of station 81 are set to an open configuration in which paddles 88 of each device 86 are parted to permit insertion/withdrawal of relative pack 3. More specifically, each pack 3 is inserted/withdrawn through the open end of the respective housing defined by relative device 86.

As packs 3 are advanced, groove 87 of each device 86 of station 81 is engaged by portion 61, formed at station 80, of relative pack 3.

Prefolding assembly 135 folds faces 44, portions 59*a*, 59*b*, and opposite lateral portions of strip 53 of portion 50*b* to form two flaps 128 converging towards axis R, and folds an intermediate portion of said strip 53 and walls 54*a*, 54*b* to form a flat surface 119 (FIG. 11) onto which flaps 128 are subsequently folded.

More specifically, each flap 128 is defined, on the opposite side to axis R, by a relative face 44, and, on the side facing axis R, by corresponding portions 59*a*, 59*b* and by the relative lateral portion of strip 53 of portion 50*b*.

Surface 119 extends perpendicularly to walls 49*a*, 49*b* of pack 3 and to axis R.

More specifically, assembly 135 comprises an arc-shaped wall 137 for folding the intermediate portion of strip 53 of portion 50*b* and walls 54*a*, 54*b* to form surface 119.

Assembly 135 also comprises a roller 136 for exerting further pressure on the intermediate portion of strip 53 of portion 50*b* and on walls 54*a*, 54*b*; and two cross members 138 (only one shown in FIG. 1) located on opposite sides of roller 136, and each defining, with roller 136, a gap through which a respective flap 128 is fed. The gap gets smaller from the first to the second angular position of devices 86 of station 81, so as to fold the relative flap by a given angle, of normally 45 degrees, towards axis R.

More specifically, wall 137 extends along an acute angle of roughly forty-five degrees from the first angular position of devices 86 of station 81, and cross members 138 extend from the end of wall 137, opposite the end at the first angular position of devices 86, to the second angular position of devices 86.

Assembly 139 is adjustable in position with respect to axis 140 of hub 85, so as to be usable with packs 3 having different-sized portions 49.

Station 81 also comprises an arc-shaped wall 125 extending between the second and third angular position of devices 86, and which cooperates with flaps 128 to hold them in the prefolded position produced by assembly 135.

Figure 11:
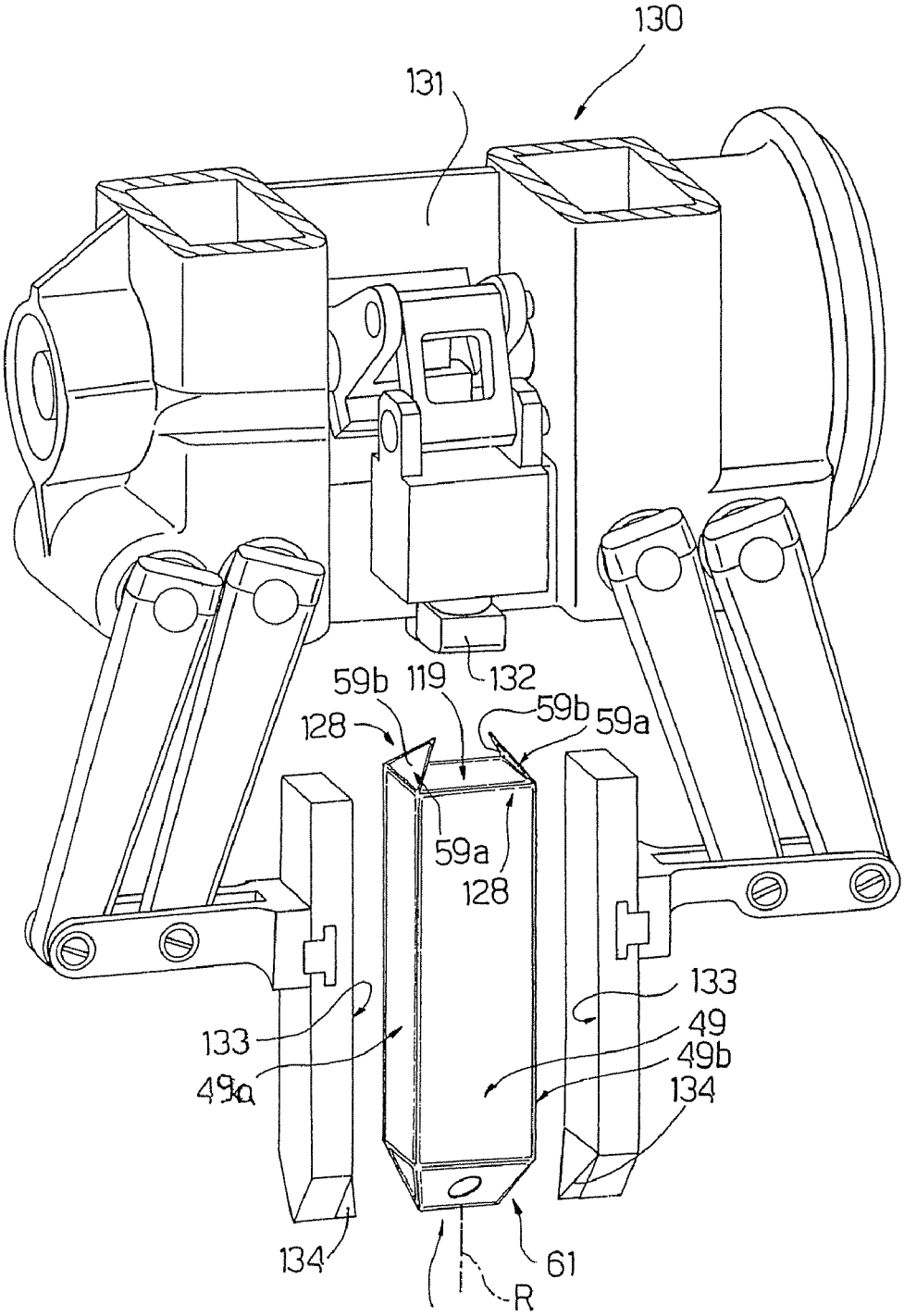
FIGS. 11 and 12 show views in perspective of two operating configurations of a second folding assembly of the FIG. 1 unit, for forming a bottom wall of the FIG. 3 package.
Figure 12:
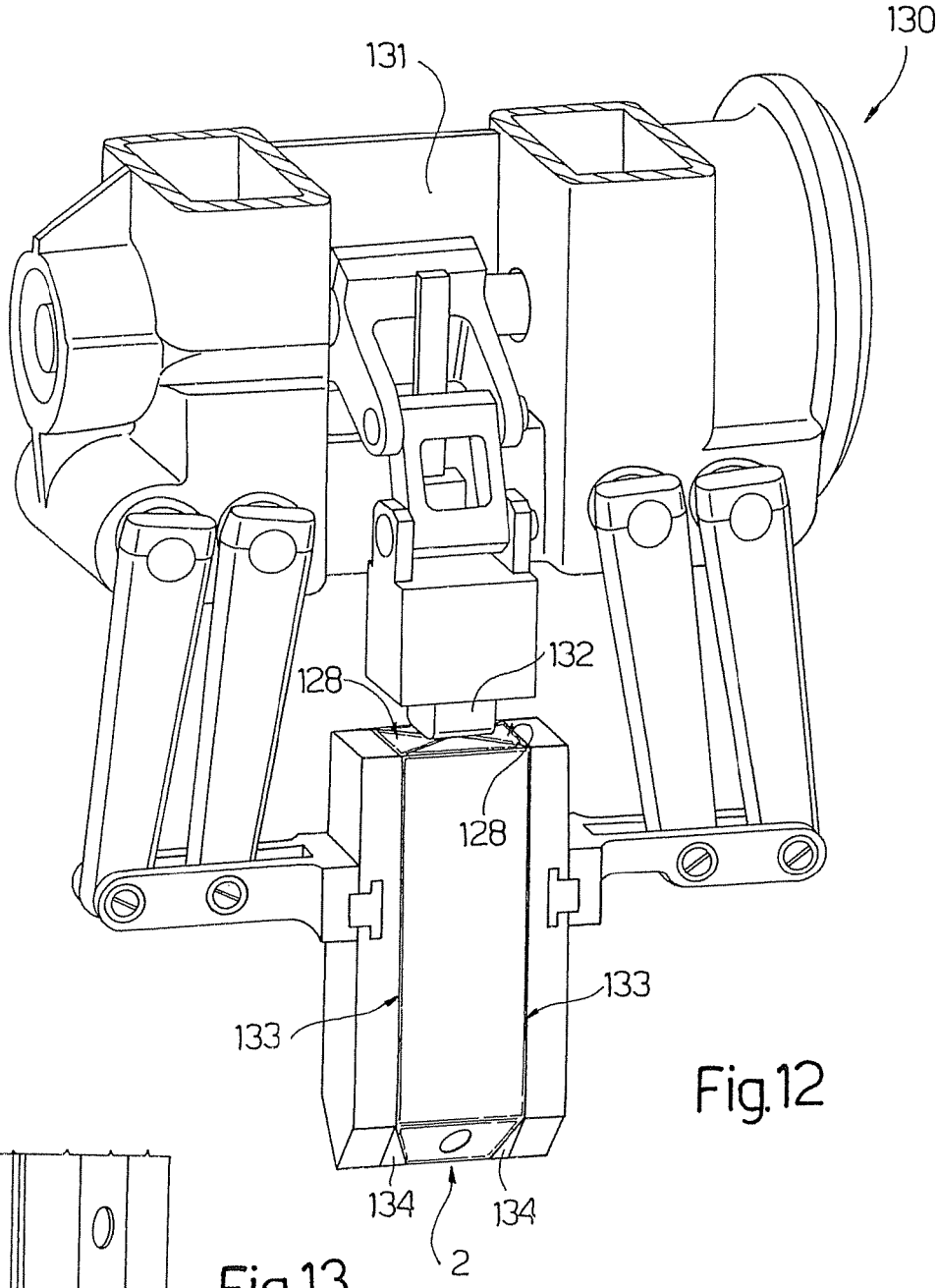

With reference to FIGS. 11 and 12, assembly 130 comprises a supporting body 131; a pressure pad 132 connected functionally to body 131 and movable back and forth radially with respect to axis 140 to fold flaps 128 onto surface 119; and two plates 133 connected functionally to body 131 and movable to and from walls 49*b* to control the volume of pack 3 when folding flaps 128.

More specifically, the movement of plates 133 is associated with the movement of pressure pad 132, so that, when pressure pad 132 cooperates with flaps 128, plates 133 cooperate with walls 49*b* (FIG. 12), and, when pressure pad 132 is detached from flaps 128, plates 133 are detached from walls 49*b* (FIG. 11).

Figure 13:
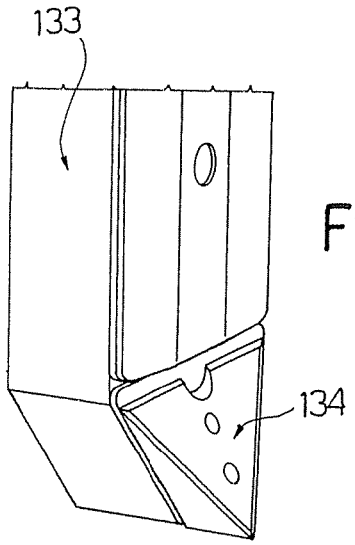
FIG. 13 shows a larger-scale detail of FIGS. 11 and 12.

With reference to FIGS. 11 and 13, at an end portion of a respective wall which cooperates with a relative wall 49*b*, each plate 133 has a sealing device 134 which cooperates with a relative flap 70, 71 to seal it to the oblique sides of walls 69.

Station 81 also comprises an arc-shaped wall 126 extending between the third and fourth angular position of devices 86 to keep flaps 128 pressed against surface 119 as flaps 128 cool.

Operation of unit 1 will now be described with reference to one pack 3, and as of a start instant in which pack 3 is supplied to station 80 of unit 1.

More specifically, inside a relative device 86 of station 80 in the first angular position, pack 3, positioned with axis R sloping slightly with respect to a horizontal plane, is housed with strip 53 of portion 50*b* inside groove 87, and with walls 49*a* gripped by paddles 88.

Rotation of hub 84 moves device 86 into the second angular position, in which pack 3 is adjacent to assembly 90.

As hub 84 rotates, edges 89 (FIGS. 9 and 10) prevent pack 3 from being spun off.

In the second angular position of device 86, motor 105 of tool 91 (FIGS. 4 to 7), by means of the cam mechanism and lever mechanisms 115, moves each plate 112 onto relative wall 49*b* of pack 3, and surface 113 of each pressure member 110 onto relative surface 56.

Next, motors 105 operate tools 91, 92 to perform the respective approach movements of respective surfaces 100.

More specifically, surface 100 of tool 91 contacts wall 51*b* of pack 3 before surface 100 of tool 92 contacts wall 51*a* of pack 3.

Next, motor 105 of tool 91 is operated further to perform the respective folding movements of surfaces 101 of tool 91, and so fold portions 52*b* onto relative surfaces 56.

More specifically, portions 52*b* are folded with respect to wall 51*b* at respective lines 22, 23, and are folded over along respective lines 40, 41 to superimpose respective panels N, Q on respective portions of respective panels E, H.

At this point, motor 105 of tool 92 is operated to perform the respective folding movements of surfaces 101 of tool 92, and so fold portions 52*a* onto respective portions 52*b*.

More specifically, portions 52*a* are folded with respect to wall 51*a* at respective lines 24, 25.

By the end of the folding movements, panels D, C are superimposed respectively on panels P, O, which in turn are superimposed respectively on panels Q, N, which are superimposed respectively on panels H, E.

Once folded, panels D, C define respective flaps 71, 70, and have respective lines 32, 31 superimposed on respective lines 23, 22.

Figure 5:
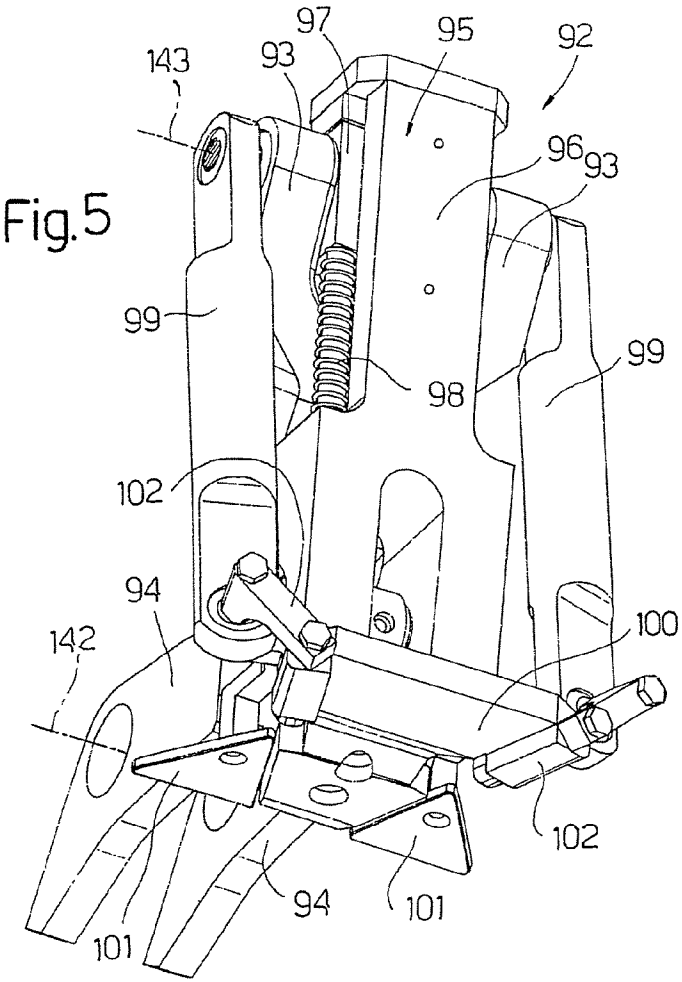
FIGS. 4 to 7 show a first folding assembly of the FIG. 1 unit, for forming the gable portion of the FIG. 3 package.
Figure 4:
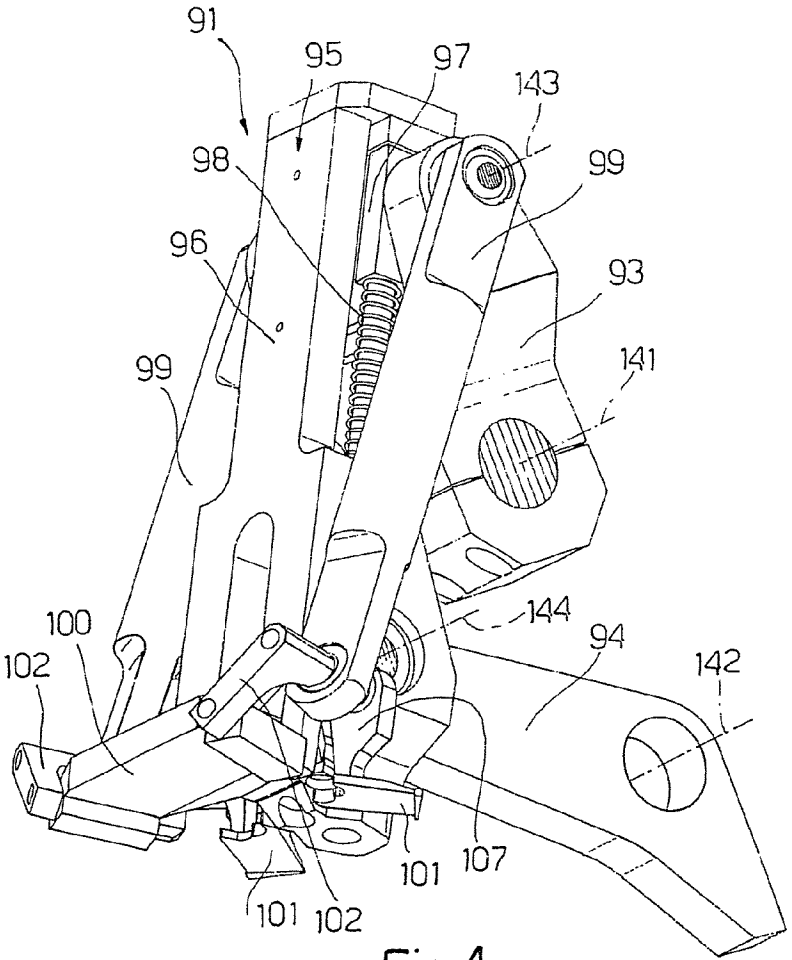
Figure 7:
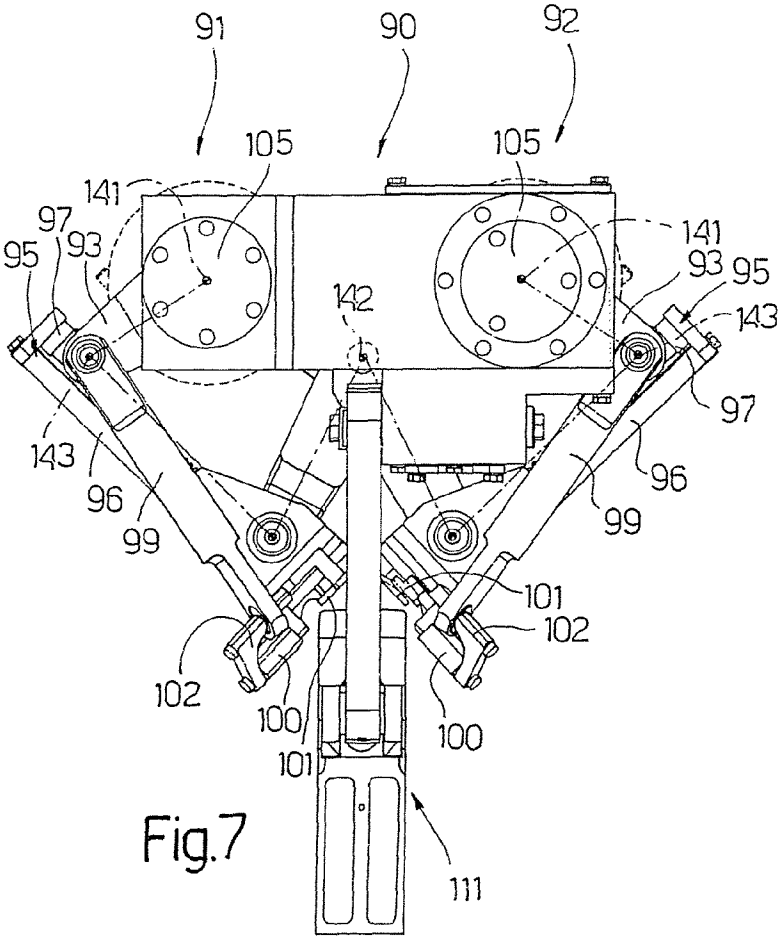
Figure 6:
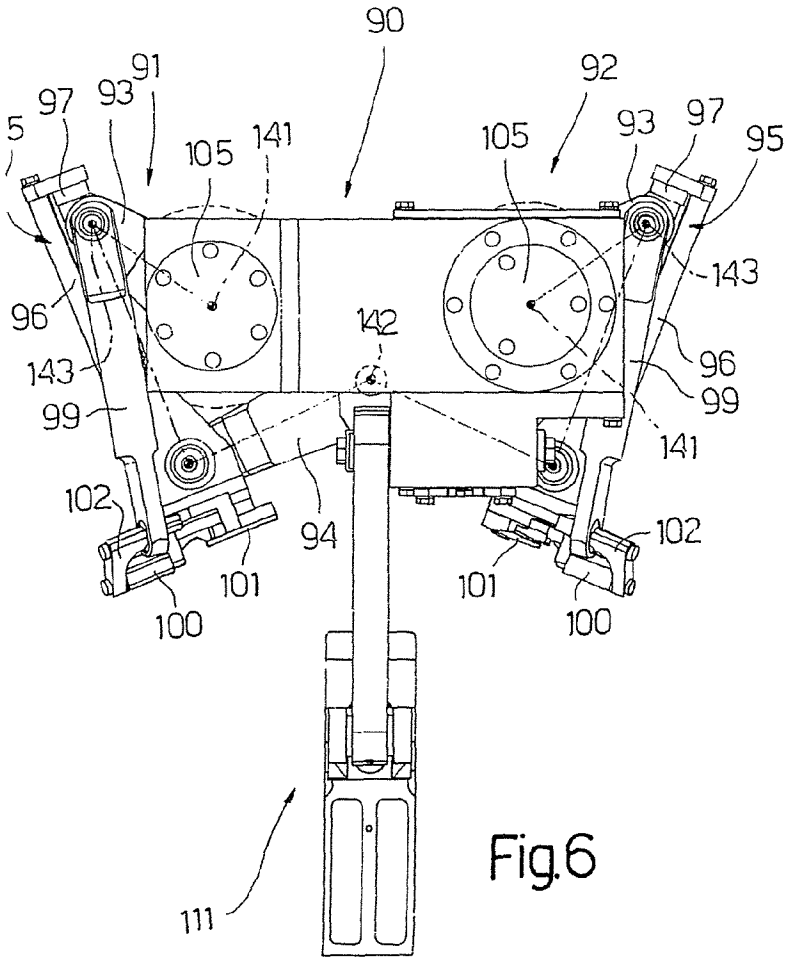

More specifically, the approach movements commence from a start position in which each member 97 rests against relative member 96 (FIGS. 4 and 5).

During the approach movements, motors 105, by means of levers 93, rotate surfaces 100, 101 of tools 91, 92, integrally with one another, about axes 141 until surfaces 100 come to rest against walls 51*a*, 51*b* of pack 3. During the approach movements, members 96, 97 of frames 95 also move integrally with one another.

Once the approach movements are completed, motors 105, by means of levers 93, rotate levers 99 and members 97 of tools 91, 92 further with respect to relative axes 143, 141, thus compressing springs 98 of tools 91, 92.

Rotation of levers 99 rotates connecting rods 102 of tools 91, 92 with respect to relative surfaces 100, and so, by means of plates 107, rotates the pairs of surfaces 101 with respect to relative surfaces 100.

By the end of the folding movements, ends 53*a*, 53*b* are detached slightly from the oblique sides of wall 69, and faces 55 are detached slightly from surfaces 56 to permit heating and sealing at station 81.

Once the folding movements are completed, motors 105 are operated in reverse to first withdraw members 110 from surfaces 56, then surfaces 101 from flaps 70, 71, and finally surfaces 100 from walls 67, 69.

In the course of the above withdrawal movements, the previously compressed springs 98 expand to restore relative members 97 to the position resting against relative members 96.

At this point, pack 3, complete with portion 61, is moved by hub 84, by means of device 86, a further ninety degrees clockwise into the third angular position, where it is picked up by conveyor 82 and transferred to station 81.

Pack 3, complete with portion 61, is removed from conveyor 82 by one of devices 86 of station 81 in the first angular position.

More specifically, inside a relative device 86 of station 81 in the first angular position, pack 3, complete with portion 61 and positioned with axis R sloping slightly with respect to a horizontal plane, is housed, inside the housing defined by relative device 86, with strip 53 of the previously formed portion 61 inside groove 87, and with walls 49*a* gripped by paddles 88.

As hub 85 rotates about relative axis 140, device 86 feeds pack 3, complete with portion 61, from the first to the second angular position, so that portion 50*b* interacts with prefolding assembly 135.

More specifically, wall 137 exerts pressure on the intermediate portion of strip 53 and on walls 54*a*, 54*b* of portion 50*b* to form surface 119, which is coplanar with wall 62.

By virtue of the shape of the gaps defined between them, roller 136 and cross members 138 fold faces 44, portions 59*a*, 59*b*, and the end portions of strip 53 of portion 50*b* so that flaps 128 converge with respect to axis R of the pack and at an angle of roughly 45 degrees with respect to axis R (FIG. 11).

Once pack 3, complete with portion 61 and with portion 50*b* folded as described above, is brought by device 86 to the second angular position, assembly 139 heats flaps 70, 71 in known manner to speed u subsequent sealing of flaps 70, 71 to the oblique sides of wall 69.

As hub 85 rotates, device 86 then moves pack 3, complete with portion 61, to the third angular position, where pressure pad 132 (FIGS. 11 and 12) folds portions 59*a*, 59*b* onto surface 119 to complete the folding of wall 62, and sealing devices 134 seal flaps 70, 71 to the oblique sides of wall 69.

More specifically, during operation of pressure pad 132, plates 133 cooperate with walls 49*b* to control the volume of pack 3.

At the third angular position, a further known heating device (not shown) heats flaps 128, and a further known sealing device (not shown) seals flaps 128 to surface 119.

The resulting finished package 2 is then fed by relative device 86 to the fourth angular position, where it is transferred to packaging machine stations downstream from unit 1.

Each device 86 may be fitted with a respective assembly 120 to reduce the volume between paddles 88 and so produce packages 2 from packs 3 having different-sized portions 49.

Using assembly 120 (FIG. 10), pack 3 may be housed with one of strips 53 inside seat 124, and with each wall 49*a* cooperating with the portion of relative paddle 88 extending between the end of relative body 121 on the opposite side to hub 84, 85, and the end of relative edge 89 on the opposite side to hub 84, 85.

The advantages of unit 1 according to the present invention will be clear from the foregoing description.

In particular, unit 1 is highly flexible by producing packages 2, with the same portion 61, from packs 3 with different-sized portions 49, by changing devices 86 or using assembly 120.

More specifically, using, for each portion 49 size, a respective device 86 with a groove 87 at a given distance from relative axis 140, packs 3 with different-sized portions 49 can be made to interact with assemblies 90, 130 at given angular positions of device 86.

Alternatively, a respective assembly 120 may be used for each portion 49 size to reduce the volume of the housing of pack 3, while at the same time causing pack 3 to interact with assemblies 90, 130 at given angular positions of device 86.

Clearly, changes may be made to unit 1 as described herein without, however, departing from the protective scope defined in the accompanying Claims.

The invention claimed is:

1. A folding unit for producing sealed packages of pourable food products from respective sealed and cut pillow packs, each having a main portion folded into a desired shape, and opposite end portions to be folded to form respective folded ends of a relative finished package;

said unit comprising:

a first folding station comprising first retaining means for securing each said pillow pack by a relative first said end portion; and first folding means for folding a relative second said end portion of said pillow pack so that the pillow pack possesses a relative folded said second end portion; and a second folding station located downstream from said first folding station in the traveling direction of said pillow packs, the second folding station comprising second retaining means for securing each said pillow pack by the relative folded said second end portion, and second folding means for folding the relative said first end portion, wherein said first and second retaining means define respective open housings for said pillow pack, said housings cooperating with outer walls of said pillow pack.

2. A unit as claimed in claim 1, comprising transfer means for transferring said pillow packs from said first folding station to said second folding station.

3. A unit as claimed in claim 2, wherein said retaining means and said folding means of at least one of said folding stations rotate with respect to one another about a first axis; and wherein, with respect to said first axis, said retaining means are located radially inwards with respect to said folding means.

4. A unit as claimed in claim 2, wherein said retaining means comprise at least one tooth projecting inwards of said housing and for preventing detachment of said pillow pack by centrifugal force.

5. A unit as claimed in claim 1, wherein said retaining means and said folding means of at least one of said folding stations rotate with respect to one another about a first axis; and wherein, with respect to said first axis, said retaining means are located radially inwards with respect to said folding means.

6. A unit as claimed in claim 5, wherein the first folding means and the first retaining means rotate with respect to one another about said first axis; and wherein said second folding means and said second retaining means rotate with respect to one another about a second axis parallel to and spaced apart from said first axis.

7. A unit as claimed in claim 6, wherein said housings rotate about the respective said first and said second axis, and are open at a radially outer peripheral end with respect to the respective said first and said second axis.

8. A unit as claimed in claim 7, wherein said first and said second retaining means comprise, at a radial end facing the respective said first and second axis, a groove for engaging said pillow pack, and two members which each cooperate with a respective wall of said pillow pack; said groove and said members defining said housing.

9. A unit as claimed in claim 8, comprising adapting means which cooperate with said first and second retaining means to adjust said housing to permit retention of pillow packs of different characteristic dimensions.

10. A unit as claimed in claim 7, comprising adapting means which cooperate with said first and second retaining means to adjust said housing to permit retention of pillow packs of different characteristic dimensions.

11. A unit as claimed in claim 10, wherein said adapting means comprise at least two bodies, each cooperating with a respective said member and which define a seat for engaging said pillow pack and interposed between said groove and said open end of said housing.

12. A unit as claimed in claim 6, wherein said retaining means comprise at least one tooth projecting inwards of said housing and for preventing detachment of said pillow pack by centrifugal force.

13. A unit as claimed in claim 5, wherein said retaining means comprise at least one tooth projecting inwards of said housing and for preventing detachment of said pillow pack by centrifugal force.

14. A unit as claimed in claim 1, wherein said retaining means comprise at least one tooth projecting inwards of said housing and for preventing detachment of said pillow pack by centrifugal force.

15. A folding unit for producing sealed packages of pourable food products from respective sealed and cut pillow packs, each having a main portion folded into a desired shape, and opposite end portions to be folded to form respective folded ends of a relative finished package;

said unit comprising:

a first folding station comprising first retaining means for securing each said pillow pack by a relative first said end portion; and first folding means for folding a relative second said end portion of said pillow pack so that the pillow pack possesses a relative folded said second end portion; and a second folding station located downstream from said first folding station in the traveling direction of said pillow packs, the second folding station comprising second retaining means for securing each said pillow pack by the relative folded said second end portion, and second folding means for folding the relative said first end portion, wherein said first and second retaining means define respective open housings for said pillow pack, said housings cooperating with outer walls of said pillow pack, and wherein said first retaining means includes at least one edge projecting inwards of its housing to thereby prevent detachment of said pillow pack by centrifugal force.

16. A unit as claimed in claim 15, wherein said at least one edge comprises at least one tooth projecting inwards of said housing and for preventing detachment of said pillow pack by centrifugal force.

* * * * *